United States Patent [19]

Rinker

[11] 4,122,750

[45] Oct. 31, 1978

[54] HOLDING DEVICE FOR CYMBALS

[76] Inventor: Gary M. Rinker, 3121 E. 5th St., Anderson, Ind. 46012

[21] Appl. No.: 794,035

[22] Filed: May 5, 1977

[51] Int. Cl.[2] ..... G10D 13/02; G10D 13/06

[52] U.S. Cl. ..... 84/421

[58] Field of Search ..... 84/421, 422 R, 422

[56] References Cited

U.S. PATENT DOCUMENTS

| | | | |
|---|---|---|---|
| 1,230,192 | 6/1917 | Manning | 84/422 |
| 3,118,339 | 1/1964 | Hoellerich | 84/421 |
| 3,167,995 | 2/1965 | La Londe | 84/421 |
| 3,705,528 | 12/1972 | Cordes | 84/421 |
| 3,994,198 | 11/1976 | Herman | 84/421 |

*Primary Examiner*—L. T. Hix
*Assistant Examiner*—Benjamin R. Fuller
*Attorney, Agent, or Firm*—Gilbert E. Alberding

[57] ABSTRACT

A holding device is described to render a pair of cymbals in a prescribed relationship to produce sound characteristics commensurate to that of conventional high hat devices. The holding device comprises a first member secured to a shaft for supporting a lower cymbal, a second member slidably engaged on the shaft and positioned above and in engagement with a head cymbal, and means connected to the shaft for urging said second member downwardly against said head cymbal to thereby yieldably hold the cymbals in contact with one another.

12 Claims, 4 Drawing Figures

HOLDING DEVICE FOR CYMBALS

BACKGROUND OF THE INVENTION

This invention relates to cymbal supporting means. More particularly, the present invention is directed to a holding device for maintaining two cymbals in a prescribed relationship to achieve markedly improved tonal vibrations upon being struck.

As is known, cymbals are used to provide certain tones, short or sustained in volume, crash sounds and other characteristic musical qualities in connection with solo and orchestral renditions. Without question the use of cymbals adds a full volume of tonal effects to imitate certain sonance patterns or to impart climactic emphasis in orchestral compositions. In general, a single cymbol or, as is usually the case, two cymbals are normally employed or utilized to achieve these tonal effects.

There are several arrangements for retaining a single cymbal on a cymbal rod, shaft or other means which would be responsive to a cymbalist. A single cymbal may, for example, be mounted to another instrument such as a bass drum which can be struck with a drum stick or, as is generally the case, the cymbal may be attached to a simple stand device which may be pedal-operated or merely struck in the conventional manner to elicit the cymbal sound. Further, rather than a single cymbal a pair of cymbals may be employed. A pair of cymbals when held one in each hand may be readily struck together with a more or less brushing motion to impart dynamic qualaties to a musical work. Also a pair of cymbals may be used to form the so-called high hat or sock stand of the modern jazz or pop bands in which one cymbal is stationary and the other is so attached as to be movable to and from the stationary cymbal, generally by means operated by depressing a foot pedal placed on the floor near the player. As soon as the downward pressure is released, the movable cymbal is drawn upwardly. By striking and using the foot pedal in certain rhythms tonal effects are readily achieved.

It is generally recognized that vibrations of solid articles such as bars often present more complex acoustical phenomena than those media having air cavities of similar configuration because apparently many more types of resonant vibration are produced therefrom. Even a simple metal rod propagates numerous waves including impressional, flexural and torsional waves when struck and set into free vibration. In effect percussion idiophones including cymbals have properties of both the vibrator and resonator combined in one element. In effect, cymbals are important percussion instruments offering a set of vibrational frequencies, the major portion of which is above about 8,000 cycles per second, the energy output extending into the very ultrasonic region.

Most devices of the prior art that utilize a conventional type of sock cymbals or high hat stand require a somewhat elaborate mechanism that make their manufacture more expensive. More importantly, however, these devices are foot operated with the attendant problem therewith. For example, oftentimes a player uses two bass drums that require both feet on equipment associated with these drums and consequently, the player is left unable to operate the pedal of conventional types of high hat devices. Nonetheless, there is a need in the art for an apparatus that produces the requisite sounds of a conventional high hat yet is less cumbersome and allows quick operation without the necessity of using a pedal or pedal-like attachment.

SUMMARY OF THE INVENTION

It is accordingly an object of the present invention to provide a cymbal retaining device having few functional parts and of simple and economic construction.

Another object of the subject invention is to provide a holding device for cymbals that allows tonal qualities substantially similar to that obtained from a standard high hat or sock cymbal stand.

Still another object of the present invention is to provide a cymbal retaining and holding device which operates effectively without pedal accessories to obtain substantially equivalent sonorous characteristics as that provided by the conventional high hat apparatus.

Another object of the present invention is to provide a pair of cymbals in an array that bring out their indefinite pitch and phonic qualities.

These and other objects of the invention which will become more readily apparent from a review of the specification, claims and a study of the attached drawing.

Briefly, in accordance with the invention a percussion instrument is described and claimed comprising an upper cymbal, a lower cymbal, both cymbals being similarly diametered, a shaft for supporting said cymbals through openings provided in the center of said cymbals, a first member secured to the shaft for supporting the lower cymbal thereon, a second member slidably engaged on said shaft and positioned proximate and in engagement with the upper cymbal, one cymbal being superimposed over the other, and means connected to the shaft for urging the upper member against said other cymbal to thereby yieldably maintain said cymbals in contact with one another.

Briefly the invention resides in the particular features which shall be more fully disclosed hereinafter. In general, the particular arrangement and especially the cymbal relationship where one circular cymbal is supported by the other, the upper or head cymbal resting upon the lower cymbal provides the requisite conditions for tonal effects. The lower and head cymbals are provided with holes at their centers through which coaxially extend a cymbal shaft. Manifestly the cymbal shaft in passing through the holes of the cymbals retain them in contact and are so mounted as to be capable of tilting freely about said shaft when struck in order to emit vibrations therefrom. In this arrangement the lower cymbal is supported at the center and the upper cymbal is supported at its peripheral edges by the peripheral edges of the lower cymbal. It is this particular arrangement in combination with the subject device that produce conditions for rendering the tonal characteristics of the present invention.

The aforementioned features with the objects and advantages which become subsequently apparent reside in the details of construction and operation as more fully hereinafter described and claimed, reference being had to the accompanying drawing forming a part hereof, wherein like numerals refer to like parts throughout.

BRIEF EXPLANATION OF THE DRAWINGS

FIG. 4 is a sectional view through the cymbals showing the same in a tilted position as would be assumed after being struck by a drum stick or the like.

DESCRIPTION OF THE PREFERRED EMBODIMENTS

Figure 1:
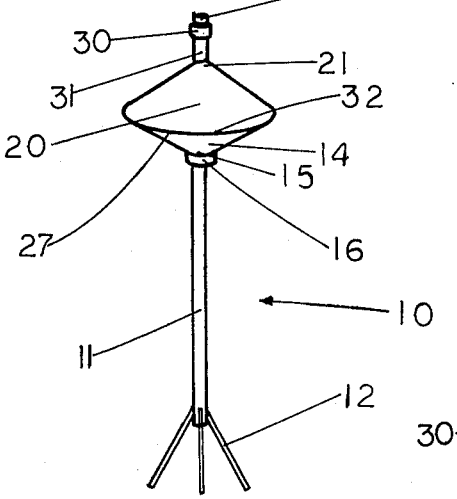
FIG. 1 is a perspective view of the cymbal stand arrangment of the instant invention, showing its outlook.
Figure 4:
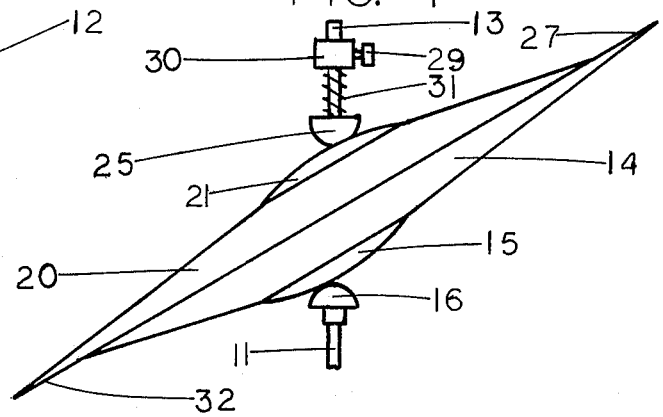
Figure 2:
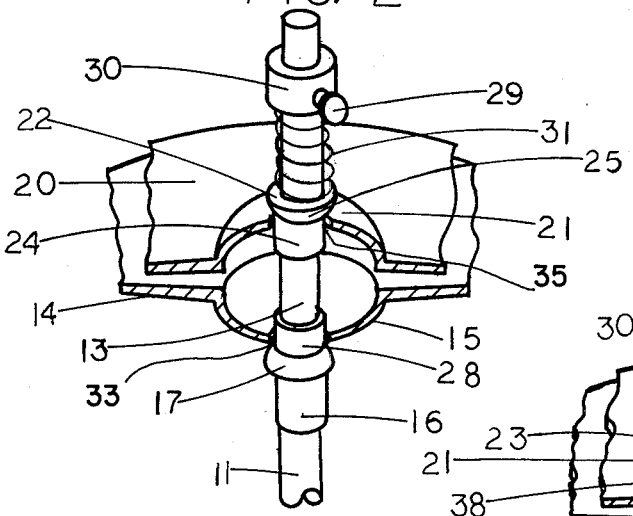
FIG. 2 is a longitudinal lateral section of one embodiment of the holding mechanism with the lower and head cymbals broken away.
Figure 3:
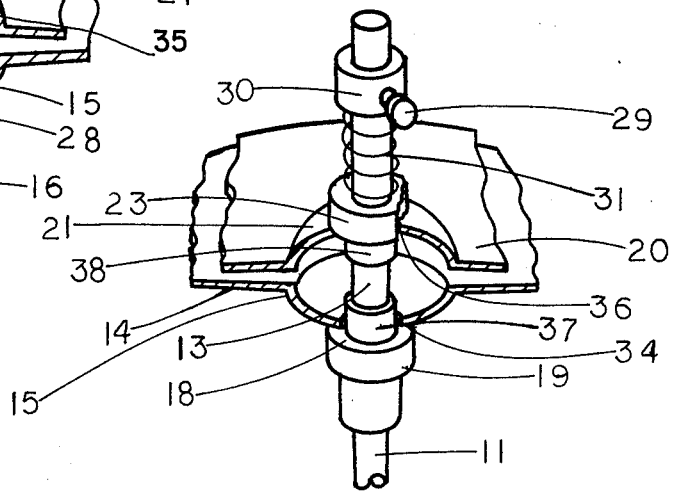
FIG. 3 is another longitudinal lateral section of another embodiment of the holding mechanism of the subject invention.

Reference will be made to all the Figures and with particular reference to FIG. 1 the stand, which is a conventional supporting structure, is denoted by numeral 10, the same having a cylinder 11 and a tripodal base 12. The upper vertically extensible or adjustable part of the upright of the stand 10 is denoted by 13, a cymbal shaft. The cymbal shaft 13 has two cymbals specially mounted thereon. One cymbal is a lower cymbal 14 and has its peripheral or rim portion 27 and a conical cupped hub portion 15 apertured to permit passage therethrough of the cymbal shaft 13. The lower cymbal is positioned upon a lower supporting member 16 which is mounted between the juncture of the shaft 13 to cylinder 11. It is to be noted from FIG. 2 that the supporting member 16 presents a substantially hemispherical portion 17 upon which rests the lower cymbal 14 whereas in FIG. 3, showing another embodiment of the subject invention, there is presented a substantially flat surface portion 18 of a supporting member 19 which supports the lower cymbal 14.

The lower supporting member 16 is provided with a depending collar portion 28 which as a bore therethrough and adapted to receive the cymbal shaft 13. It is to be noted that the collar portion 28 has a diameter slightly less than that of the diameter of the opening (designated 33) so as to allow about 1/16 inch or less clearance around said collar portion 28 and the edge of the hub portion 15 of lower cymbal 14. It is to be further noted that collar portion 28 extends within the opening 33 and thus serves as a bearing surface. It will be appreciated thus far that the lower cymbal 14 will be able to rock or tilt in any direction around the center defined by the collar portion 28 of the lower supporting member 16.

An identical or equivalent cymbal is used as an upper or head cymbal 20 which has a conical cupped hub portion 21 apertured to permit passage therethrough of the cymbal shaft 13. The head cymbal 20 is allowed to rest along its peripheral edges 32 in contact with the peripheral edges 27 of the lower cymbal 14. The head cymbal 20 is retained substantially in position by an upper supporting member 22 as shown in FIG. 2. The supporting member 22 has a substantially hemispherical configuration 25 which abuts an opening 35 and has an extended sleeve 24 which depends from the apex of member 22 and is further provided with a bore therethrough so as to receive the cymbal shaft 13. It is to be noted that the diameter of the extended sleeve 24 (FIG. 2) or the extended sleeve 38 (FIG. 3) is slightly less than that of the opening 35 (FIG. 2) or opening 36 (FIG. 3) so as to allow a slight clearance of about 1/16 inch or less between the sleeve and the edge of said cymbal.

At the upper end of cymbal shaft 13 is a ring section 30 having an opening to receive the shaft 13 and adjusted by means of a set screw 29. Connected to the ring section 30 is a spring 31 and in direct contact with the top of the upper supporting member 22 as depicted in FIG. 2 or the upper supporting member 23 as depicted in FIG. 3. The ring section 30 is positioned so as to slightly compress the spring 31 to thereby apply constant force against said supporting member. It will be appreciated that an adjustment of the set screw 29 does allow the appropriate amount of tension to be placed on the arrangement of cymbals.

Operation of the holding device for cymbals is effected by striking the cymbals downwardly or upwardly with a drum stick or the like thereby causing the cymbals to vibrate and emit sound. Further, the cymbals may be struck at their outer edge, for example, with the middle of the drum stick and pushed downwardly to cause the cymbals to tilt or rock simultaneously. The cymbals after being struck within a short time return to their normal position. The compression afforded by the spring means maintains the two cymbals in an overlapping or superimposed position. In general, upon striking the cymbals to produce a tilting thereof it is observed that the cymbals come quickly to a state of rest, that is, one in which the cymbals are in a completely overlapping relationship. This effect is most advantageous in that it apparently retains the cymbals together along their peripheral edges after receiving a singular blow. In practice this effect produces the more or less equivalent of the snapping together characteristic often associated with a high hat or sock stand by merely pushing downwardly on the pedal. The particular arrangement of the subject device facilitates the desirable cymbal sound without undesirable noise.

The material forming the supporting members including their collar portions may be made from numerous types of material but it has been found advantageous to have the same made of plastic or elastomeric substances as they are readily moldable and do offer excellent contact areas for the metal cymbals.

It is believed that a careful consideration of the specification in conjunction with the means of the drawing will enable the reader to obtain a clear and comprehensive understanding of the subject matter of the invention, the features and advantages, mode of use and improved result which is assured the user.

The foregoing is considered as illustrative only of the principles of the invention. Further, since a number of modifications and changes will readily occur to those skilled in the art, it is not desired to limit the invention to the exact construction shown and described, and accordingly all suitable modifications and equivalents may be resorted to, falling within the scope of the invention as claimed.

I claim:

1. In a percussion instrument having a head cymbal and a lower cymbal mounted to a shaft through their openings for supporting said cymbals thereon, a holding device therefor comprising a first member secured to the shaft for supporting said lower cymbal thereon, a second member slidably engaged on said shaft and positioned above and in engagement with said head cymbal, and means connected to the shaft for urging said second member downwardly against said head cymbal to thereby yieldably hold the cymbals in contact with one another.

2. A holding device of claim 1 wherein the first and second members are each provided with bearing portions capable of extending within the openings of each cymbal.

3. A holding device of claim 2 wherein the diameter of each of the bearing portions are slightly less than the diameter of the openings of the head and lower cymbals allowing said cymbals to be tilted during a percussion operation.

4. A holding device of claim 1 wherein the members are curved.

5. In a percussion instrument having a head cymbal and a lower cymbal connected to the shaft through openings defined therein for supporting said cymbals thereon, a holding device therefor comprising a first member secured to the shaft for supporting said lower member, said first member having a first bearing sleeve depending therefrom and extending within the opening of the lower cymbal, a second member slidably engaged on said shaft and positioned above and in engagement with said head cymbal, said second member being provided with a second bearing sleeve depending therefrom and extending within the opening of the lower cymbal, and means connected to the shaft for biasing said second member towards and against said head cymbal to thereby yieldably maintain the cymbals in contact with one another.

6. A holding device as recited in claim 5 wherein the means for biasing includes a spring and a retaining means connected to said shaft.

7. A holding device as recited in claim 5 wherein the first and second members are substantially curved at their portions contacting the cymbals.

8. A holding device as recited in claim 5 wherein the first and second members are substantially domed at their portions contacting the cymbals.

9. A holding device as recited in claim 5 wherein the first and second members are substantially flat at their portions contacting the cymbals.

10. In a percussion instrument having a head cymbal and a lower cymbal mounted to a shaft for supporting said cymbals thereon a holding device therefor comprising a first curved member secured to the shaft for supporting said lower cymbal, said first member having a first bearing sleeve extending upwardly therefrom for a length suitable to pass through the opening of the lower cymbal, a second member slidably engaged on said shaft and positioned above and in engagement with said head cymbal, said second member being provided with a second bearing sleeve extending downwardly therefrom and within the opening of the head cymbal, and means connected to the shaft for forcing said second member towards and against said head cymbal, said forcing means including a coil spring and a retaining means connected to said spring for yieldably maintaining the cymbals in contact with one another.

11. A device for allowing a pair of cymbals to be played to effect sound characteristics therefrom, including a lower cymbal and a head cymbal, said cymbals being provided with an opening in their centers, a cymbal shaft for supporting said cymbals, said shaft passing through the centers thereof, wherein the improvement comprises a retaining member affixed to said cymbal shaft, said member having a surface section for contacting a portion of the lower cymbal at the center thereof, the head cymbal being situated above and in engagement with the peripheral edges of the lower cymbal, and means mounted to said cymbal shaft for urging the head cymbal into continual contact with the lower cymbal when said cymbals are in a position of rest and in a state of vibration.

12. A device as recited in claim 11 wherein said urging means includes a coil spring attached at one end to the retaining means for biasing said head cymbal downwardly and against said lower cymbal.

* * * * *